US008613275B1

(12) United States Patent
Ogg et al.

(10) Patent No.: US 8,613,275 B1
(45) Date of Patent: Dec. 24, 2013

(54) GOLF BALL LAUNCHER

(75) Inventors: Steve Ogg, Carlsbad, CA (US); Benjamin J. Karpen, San Antonio, TX (US); Dana N. Mecke, Bulvedere, TX (US); Elissa T. Morris, Cove, TX (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/616,406

(22) Filed: Sep. 14, 2012

Related U.S. Application Data

(60) Provisional application No. 61/535,218, filed on Sep. 15, 2011.

(51) Int. Cl.
*F41B 11/26* (2006.01)

(52) U.S. Cl.
USPC ..... 124/81; 124/73; 124/56; 124/64; 124/78; 124/71

(58) Field of Classification Search
USPC ..... 124/60, 64–65, 67, 69–71, 73, 75–78, 124/56, 63–65
See application file for complete search history.

(56) References Cited

U.S. PATENT DOCUMENTS

| | | | | |
|---|---|---|---|---|
| 3,680,540 | A * | 8/1972 | Stengl | 124/73 |
| 4,345,578 | A * | 8/1982 | Speer | 124/56 |
| 5,496,025 | A * | 3/1996 | Phillips et al. | 124/56 |
| 6,167,878 | B1 * | 1/2001 | Nickerson et al. | 124/64 |
| 6,202,636 | B1 * | 3/2001 | O'Brien | 124/71 |
| 6,286,364 | B1 | 9/2001 | Aoyama et al. | |
| 7,063,623 | B2 | 6/2006 | Wengert | |
| 2004/0139955 | A1 * | 7/2004 | Hansen et al. | 124/56 |
| 2006/0196490 | A1 * | 9/2006 | Davidson et al. | 124/78 |
| 2011/0056473 | A1 * | 3/2011 | Bissonnette et al. | 124/81 |

* cited by examiner

*Primary Examiner* — Michelle Clement
*Assistant Examiner* — John D Cooper
(74) *Attorney, Agent, or Firm* — Michael A. Catania; Sonia Lari; Rebecca Hanovice

(57) ABSTRACT

The present invention comprises a golf ball launcher, the golf ball launcher comprising: a frame, a firing barrel, a firing slot, an air compressor, an accelerator housing and an acceleration mechanism comprising an upper belt mechanism and a lower belt mechanism.

5 Claims, 11 Drawing Sheets

GOLF BALL LAUNCHER

CROSS REFERENCES TO RELATED APPLICATIONS

This application claims priority to U.S. Provisional Patent Application 61/535,218 filed on Sep. 15, 2011, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf ball launcher. More specifically, the present invention relates to a high performance golf ball launcher.

BRIEF SUMMARY OF THE INVENTION

One aspect of the present invention is a high performance compact golf ball launcher. The golf ball launcher preferably includes a frame, an air compressor, a compressed air tube, a valve, a firing barrel, and accelerator, an accelerator housing and an acceleration mechanism.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
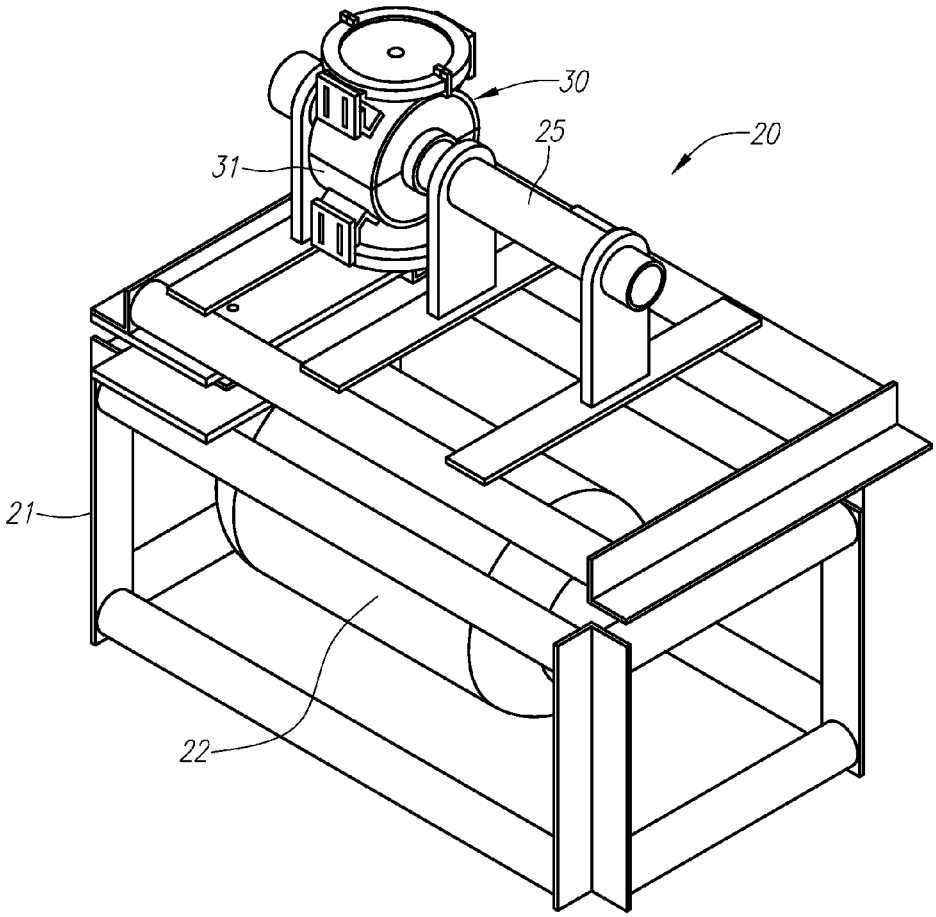
FIG. 1 is a top perspective view of a frame and an air compressor of a golf ball launcher.

As shown in the figures, a golf ball launcher 20 preferably includes a frame 21, an air compressor 22, a compressed air tube 23, a valve 24, a firing barrel 25, and accelerator 30, an accelerator housing 31 and an acceleration mechanism 35. A golf ball 50 is placed within a firing slot and launched through the firing barrel 25 using compressed air from the air compressor 22.

As shown in FIG. 1 which is a top perspective view of a frame and an air compressor 22 of a golf ball launcher, the golf ball launcher comprises a firing barrel with a tubular front end. Preferably, the air compressor 22 is configured and dimensioned to propel an object at any desired speed, spin, trajectory, and the like.

Figure 2:
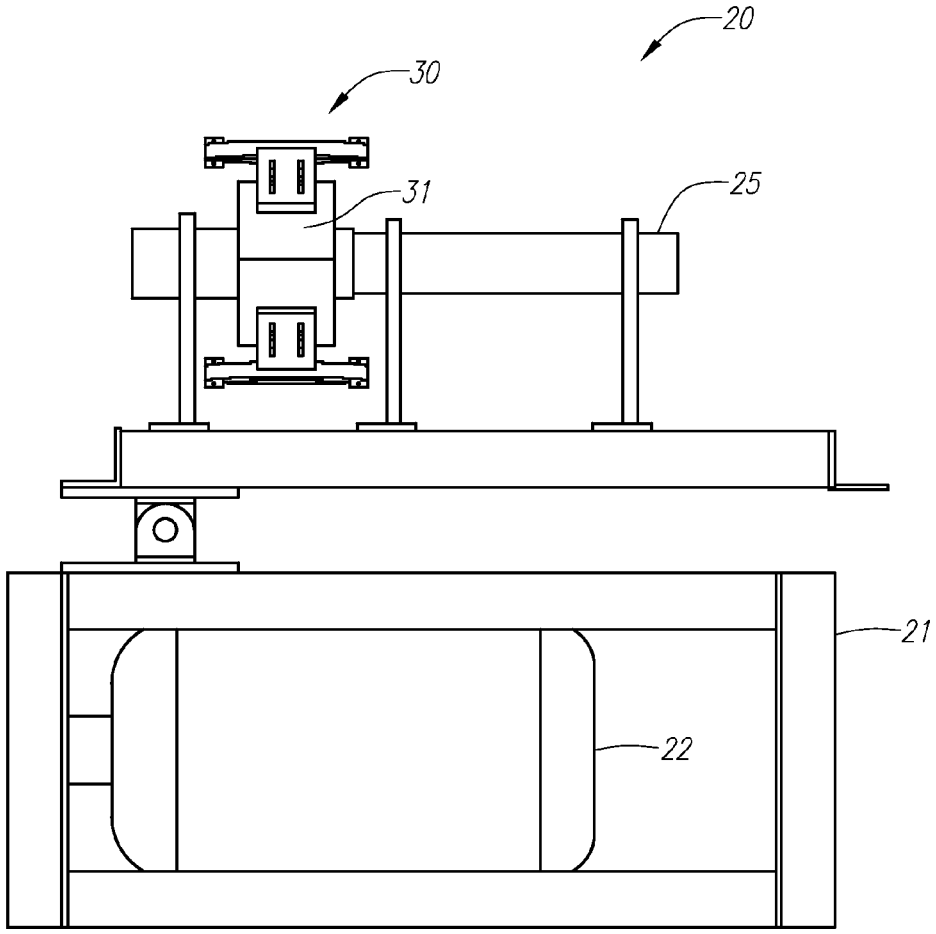
FIG. 2 is a side view of a golf ball launcher.

FIG. 2 is a side view of a golf ball launcher. The firing barrel 25 allows the golf ball 50 to pass through and have a desired speed and spin imparted to it. Ball velocities ranging from 100 miles per hour to 300 miles per hour can be achieved. Further, the air compressor 22 and firing barrel 25 allow for a velocity to be repeated within a predetermined tolerance. The accelerator housing is composed of an upper housing 31*a* and a lower housing 31*b*.

Figure 3:
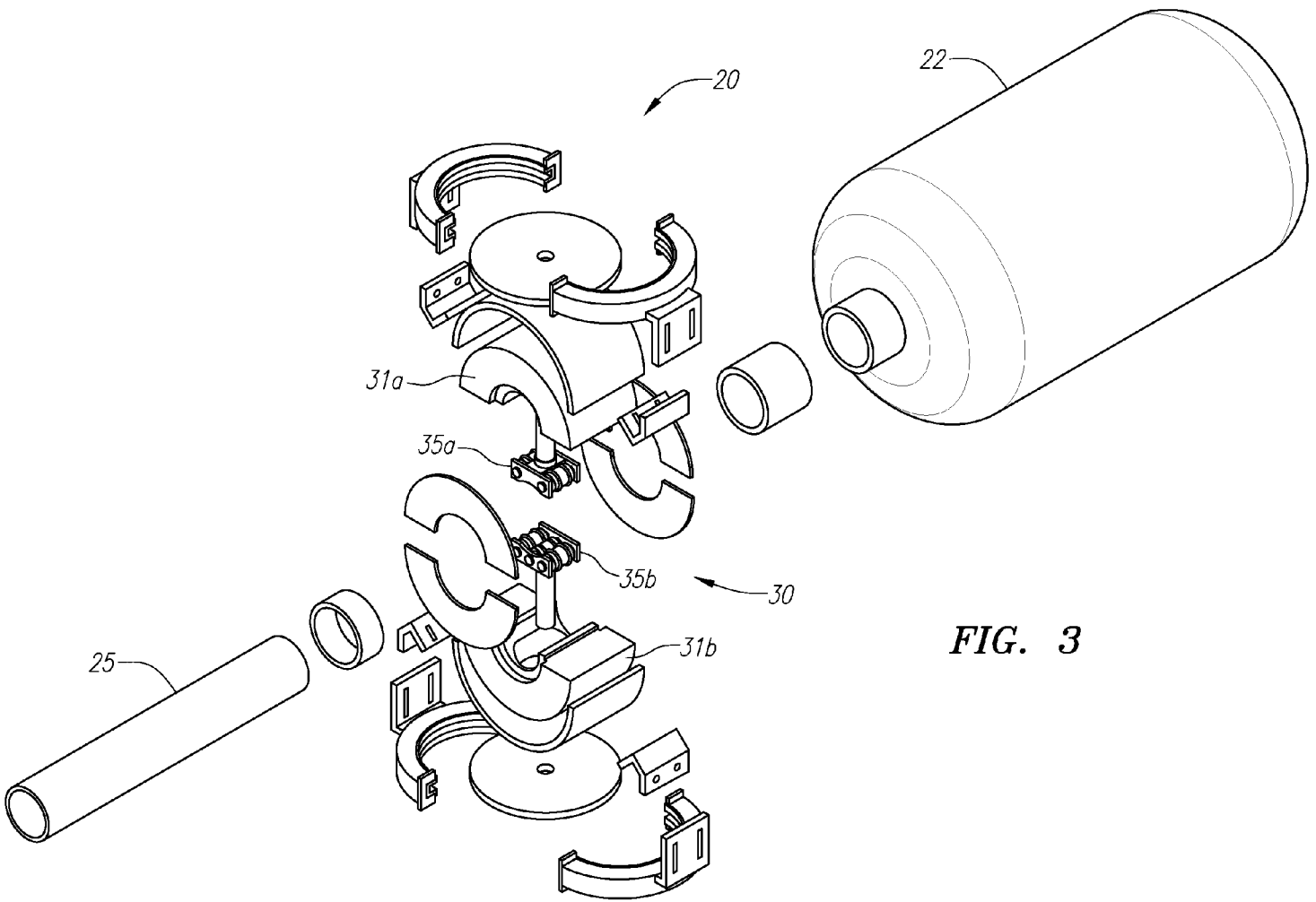
FIG. 3 is an exploded view of a golf ball launcher.

FIG. 3 is an exploded view of a golf ball launcher. The apparatus of this invention allows for the firing of golf balls 50 within certain repeatability, such as firing balls at a constant velocity. Further, a golf ball 50 can be repeatedly launched at a desired angle. As shown in FIG. 3 belts, wheels, bearings and other mechanical devices including jam nuts and snap rings are included as safety devices. The acceleration mechanism 35 comprises an upper belt mechanism 35*a* and a lower belt mechanism 35*b*.

Figure 4:
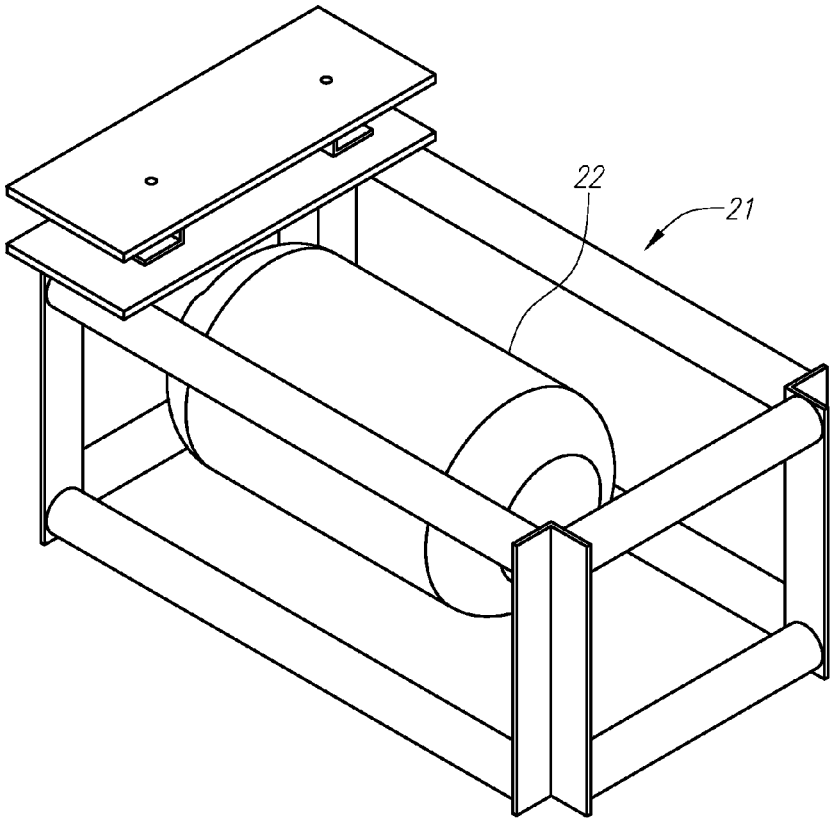
FIG. 4 is a top perspective view of a frame and an air compressor of a golf ball launcher.

FIG. 4 is a top perspective view of a frame and an air compressor of a golf ball launcher.

Figure 5:
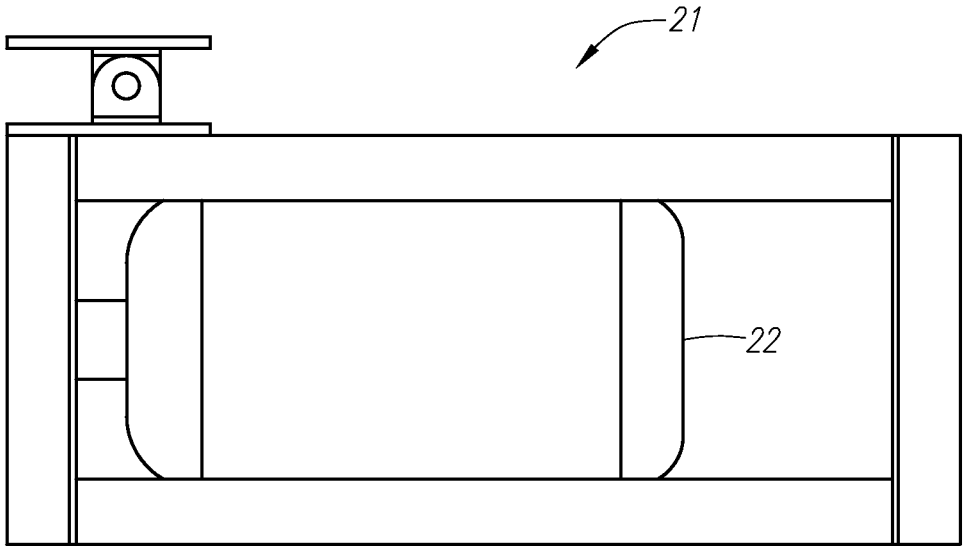
FIG. 5 is a side view of a frame and an air compressor of a golf ball launcher.

FIG. 5 is a side view of a frame and an air compressor of a golf ball launcher.

Figure 6:
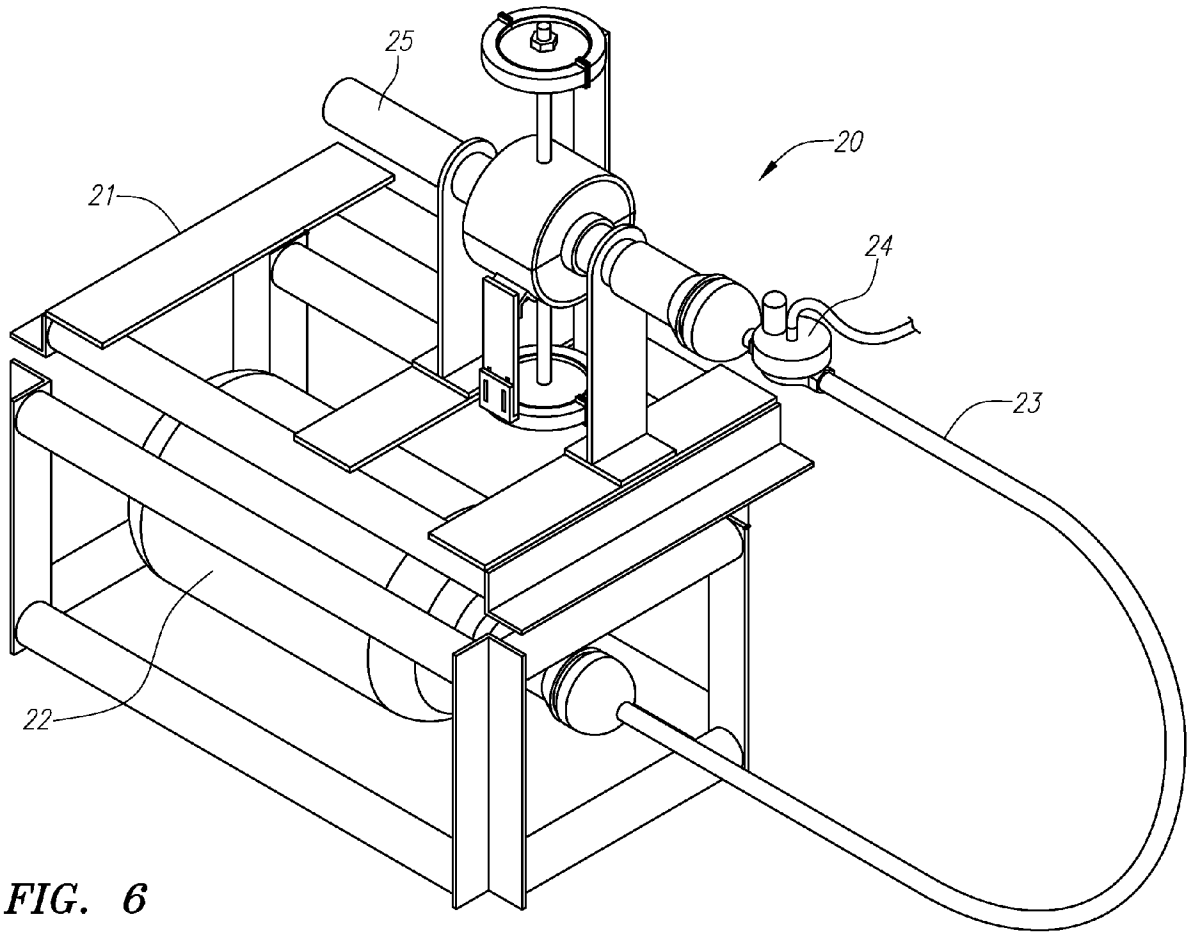
FIG. 6 is a top perspective view of a frame and an air compressor of a golf ball launcher.

FIG. 6 is a top perspective view of a frame and an air compressor of a golf ball launcher. As shown in FIG. 6, the present invention preferably includes a valve 24, wherein the valve prevents air from being forced into the barrel of the air compressor 22. By preventing the air from entering the air compressor 22, the velocity and/or trajectory of the ball is not affected.

Figure 7:
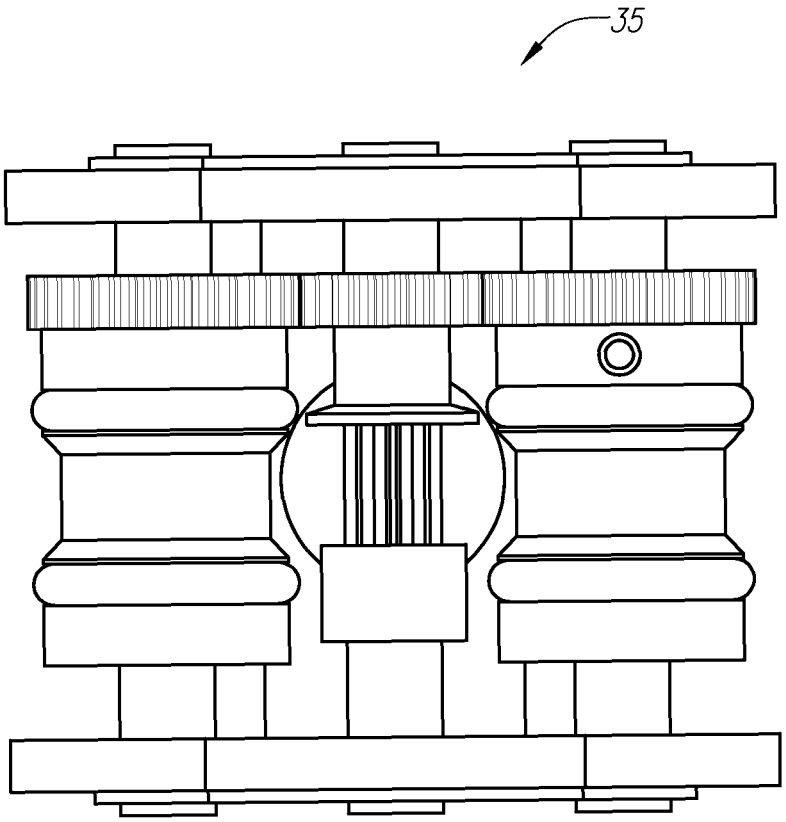
FIG. 7 is an isolated view of an acceleration mechanism of a golf ball launcher.

FIG. 7 is an isolated view of an acceleration mechanism of a golf ball launcher. The acceleration mechanism preferably comprises an upper belt mechanism and a lower belt mechanism, where in the acceleration mechanism is a belt drive assembly. The belt drive is preferably composed of rubber, leather, urethane, PVC, and/or wire meshes. Preferably, the tension of the belt is maintained such that the vibration is between 20 Hz and 200 Hz.

Figure 8:
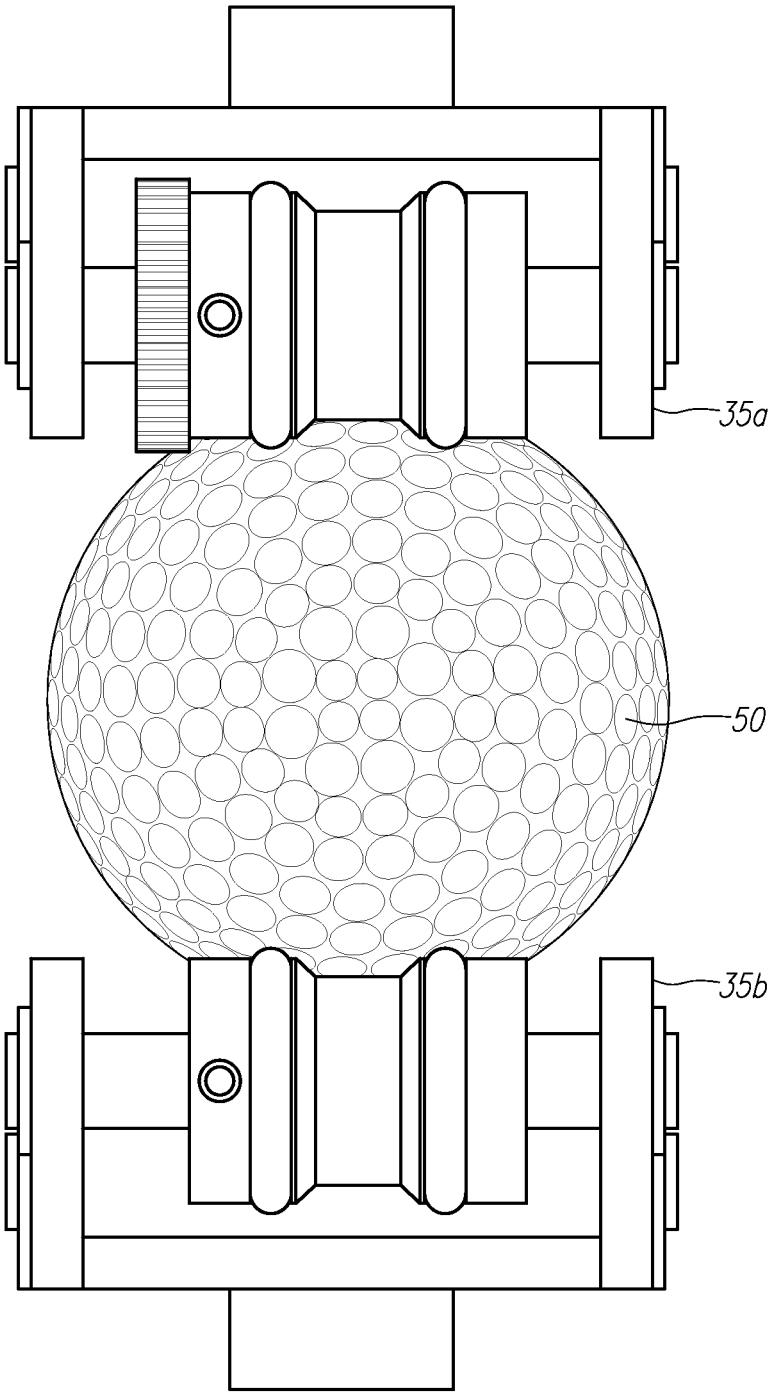
FIG. 8 is an isolated view of an acceleration mechanism of a golf ball launcher with a golf ball engaged in a firing slot.

FIG. 8 is an isolated view of an acceleration mechanism of a golf ball launcher with a golf ball engaged in a firing slot.

Figure 9:
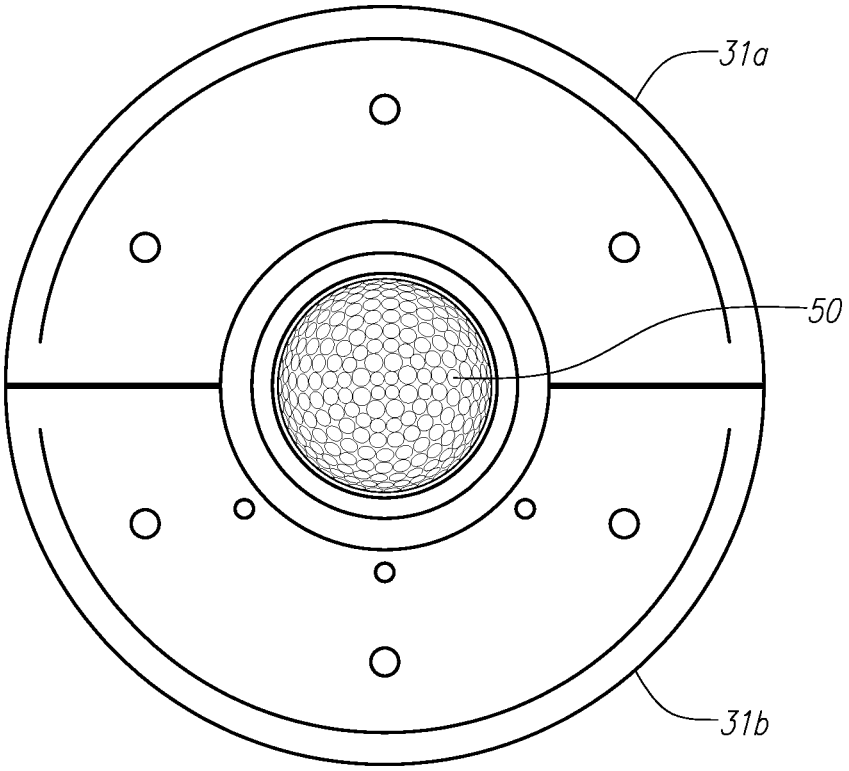
FIG. 9 is an isolated view of an accelerator housing of a golf ball launcher with a golf ball engaged in a firing slot.

FIG. 9 is an isolated view of an accelerator housing of a golf ball launcher with a golf ball engaged in a firing slot. As shown in FIG. 9, the accelerator housing 31 comprises an upper housing 31*a* and a lower housing 31*b*.

Figure 10:
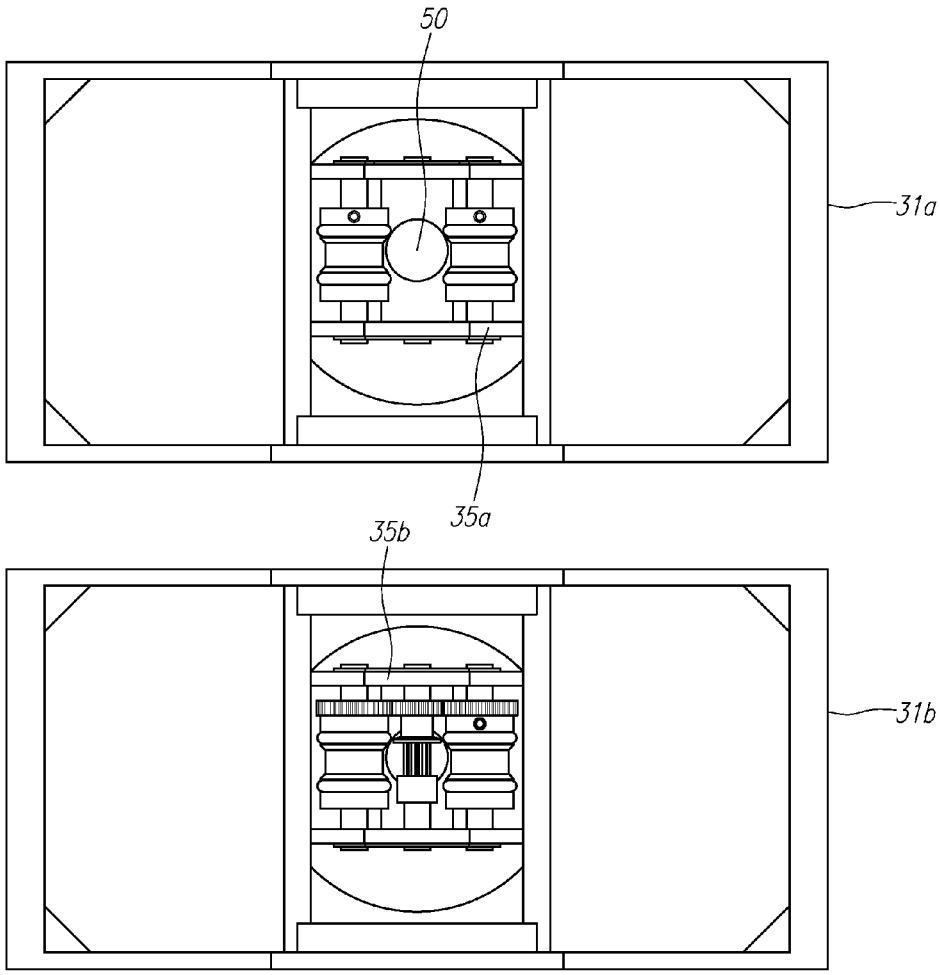
FIG. 10 is an isolated view of a disassembled accelerator housing of a golf ball launcher with a golf ball engaged in a firing slot.

FIG. 10 is an isolated view of a disassembled accelerator housing of a golf ball launcher with a golf ball engaged in a firing slot.

Figure 11:
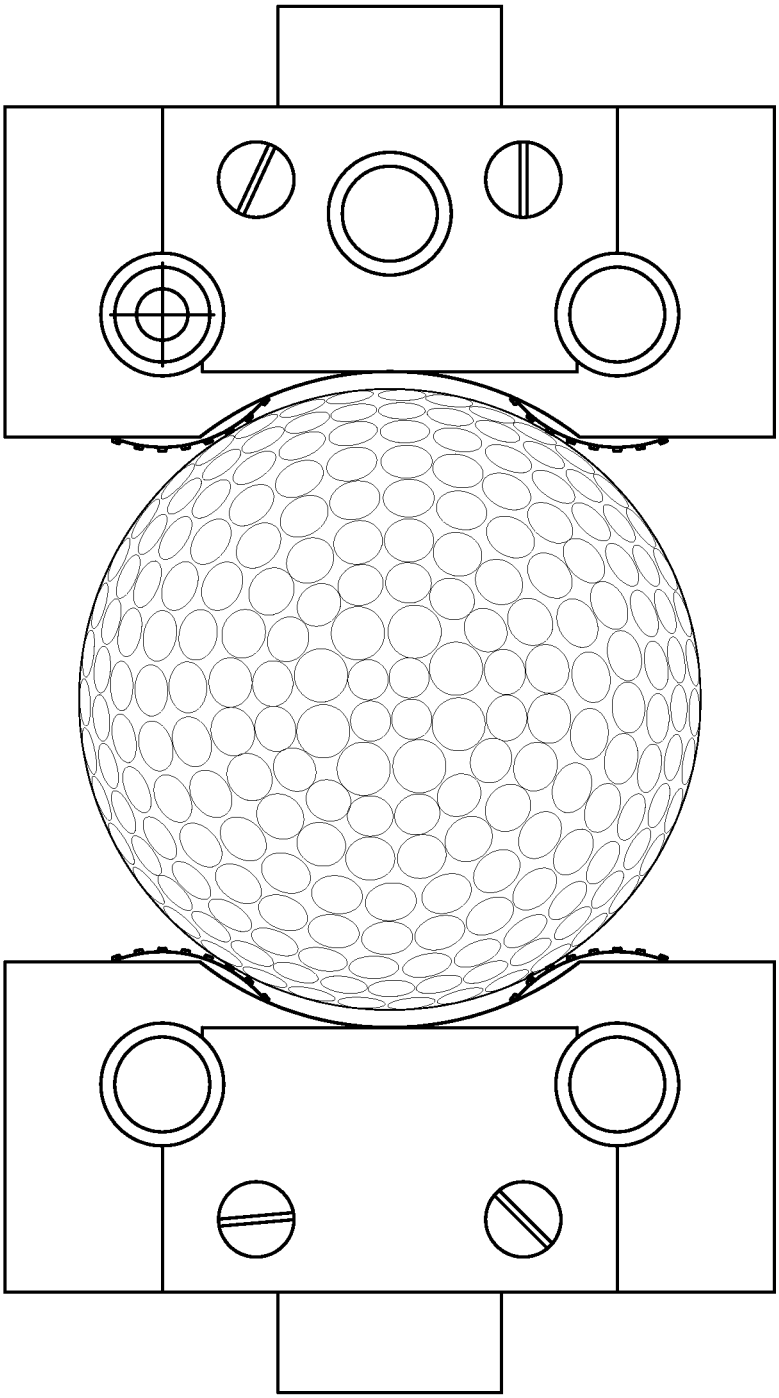
FIG. 11 is an isolated side view of an acceleration mechanism of a golf ball launcher with a golf ball engaged in a firing slot.

FIG. 11 is an isolated side view of an acceleration mechanism of a golf ball launcher with a golf ball engaged in a firing slot.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims.

Therefore, the embodiments of the invention in which an exclusive property or privilege is claimed are defined in the following appended claims.

We claim:

1. A golf ball launcher, the golf ball launcher comprising:

a frame;

a firing barrel;

a firing slot;

an air compressor comprising a barrel;

a valve;

an accelerator housing; and an acceleration mechanism comprising an upper belt mechanism and a lower belt mechanism;

wherein the firing barrel is mounted on top of the frame;

wherein the firing slot is in flow communication with the firing barrel;

wherein is the air compressor is positioned within the frame;

wherein the accelerator housing is positioned on top of the frame and the acceleration mechanism is within the accelerator housing;

wherein the valve prevents air from being forced into the barrel of the air compressor;

wherein the upper belt mechanism and the lower belt mechanism of the accelerator mechanism accelerate a single golf ball within the firing slot;

wherein a single golf ball placed within the firing slot is launched with an arbitrary spin axis from the firing barrel.

2. The golf ball launcher according to claim 1 wherein the frame has a height of approximately 2 feet.

3. The golf ball launcher according to claim 1 further comprising a compressed air tube.

4. The golf ball launcher according to claim 1 wherein the accelerator housing comprises an outer layer and an inner layer.

5. The golf ball launcher according to claim 1 wherein the firing barrel is comprised of a natural rubber.

* * * * *